United States Patent [19]

Kalkanoglu

[11] Patent Number: 4,757,652

[45] Date of Patent: Jul. 19, 1988

[54] ROOFING PRODUCT

[75] Inventor: Husnu Kalkanoglu, Swarthmore, Pa.

[73] Assignee: Tarmac Roofing Systems, Inc., Wilmington, Del.

[21] Appl. No.: 81,818

[22] Filed: Aug. 5, 1987

[51] Int. Cl.[4] ..... E04D 5/10

[52] U.S. Cl. ..... 52/173 R; 52/420; 52/748

[58] Field of Search ..... 52/419, 420, 173 R, 52/551; 428/40, 41, 906, 343; 128/156

[56] References Cited

U.S. PATENT DOCUMENTS

| | | | |
|---|---|---|---|
| 2,705,209 | 3/1955 | Rowe | 428/41 |
| 2,755,555 | 7/1956 | Spaeder | 40/594 |
| 2,863,405 | 12/1958 | Leibrook | 52/420 |
| 3,121,649 | 2/1964 | Oliver | 52/419 |
| 3,434,259 | 3/1969 | Corbin | 52/420 |
| 3,848,384 | 11/1974 | Eaton | 52/420 |
| 3,870,593 | 3/1975 | Elton | 128/156 |
| 3,903,340 | 9/1975 | Shepherd | 428/343 |
| 4,348,440 | 9/1982 | Kriozere | 428/41 |
| 4,386,981 | 6/1983 | Clapperton | 428/41 |
| 4,503,106 | 3/1985 | Cogliano | 428/40 |
| 4,621,000 | 11/1986 | Frick | 428/40 |
| 4,684,288 | 8/1987 | Chapa | 428/40 |

*Primary Examiner*—John E. Murtagh

*Attorney, Agent, or Firm*—Sherman Levy

[57] ABSTRACT

A roofing product is provided that has a release film on the back surface thereof, and the release film is split to allow the material to be flopped back; one side is stuck and then the other side is flopped down. The roofing product includes a top surface having roofing granules thereon and wherein a selvedge is provided along the length of the product for overlapping several of them on the roof. An important aspect of the present invention is that the back surface has a silicone coated 2-section release film. The composition of the roofing product consists of polymer-modified bitumen which makes the product self-adhering. There is a fiberglass reinforcement inside the product. The peel-off film on the back surface of the product consists of two separate strips instead of a single strip or film.

4 Claims, 2 Drawing Sheets

FIG 1
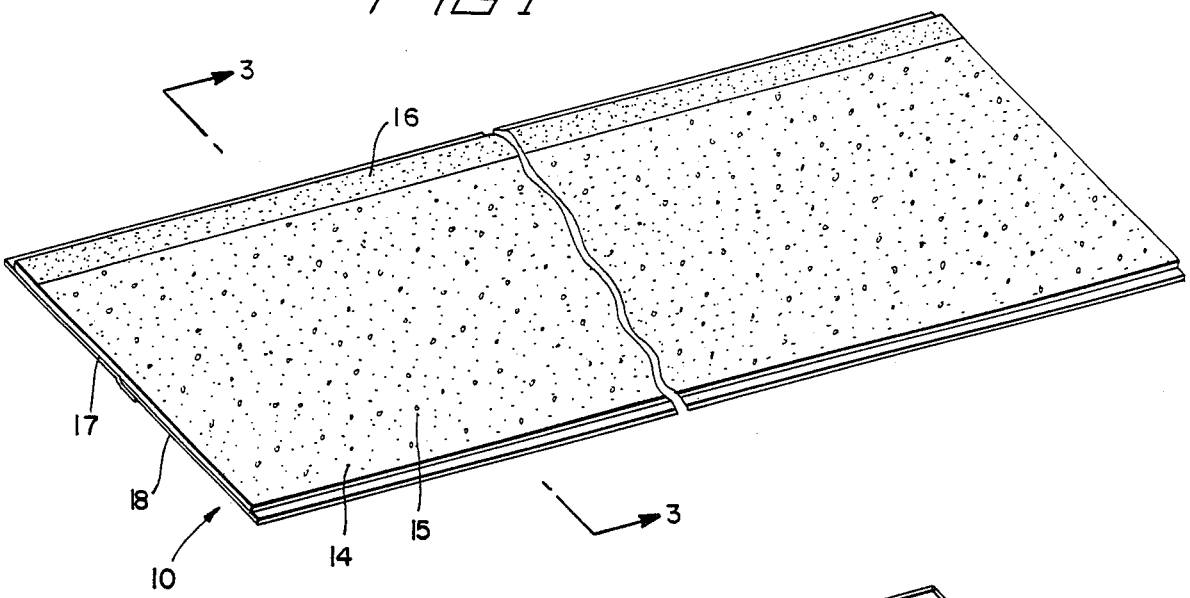
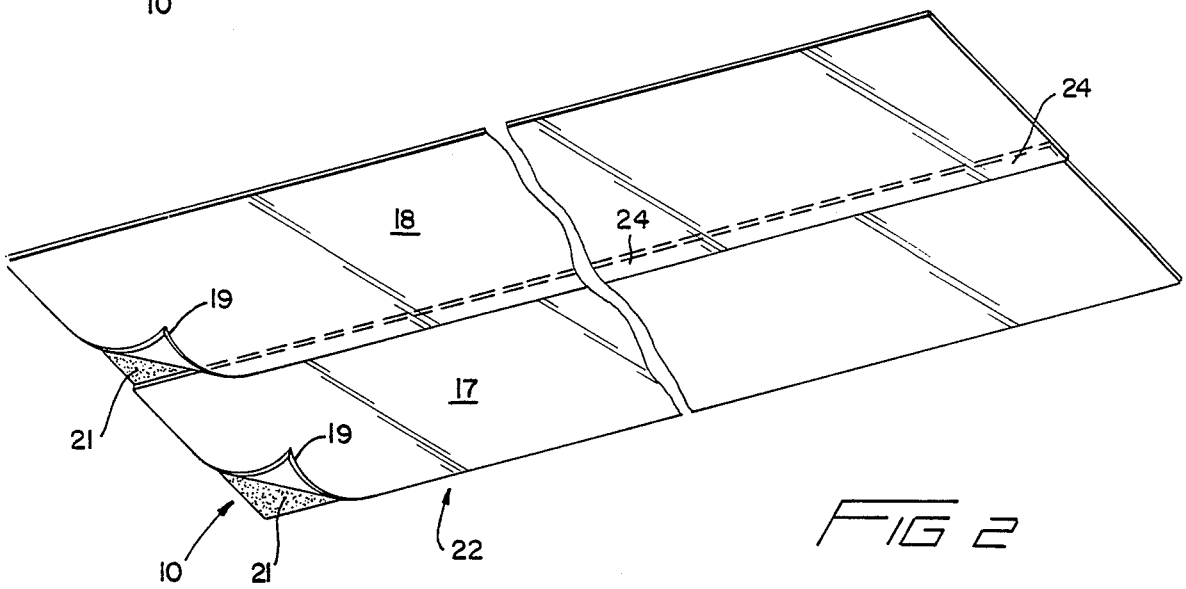
FIG 2
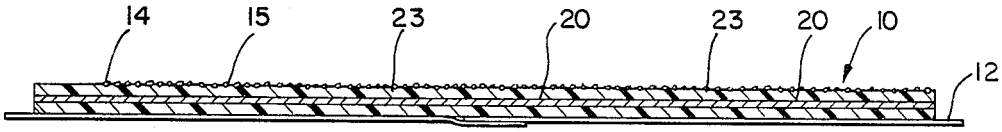
FIG 3

FIG 4
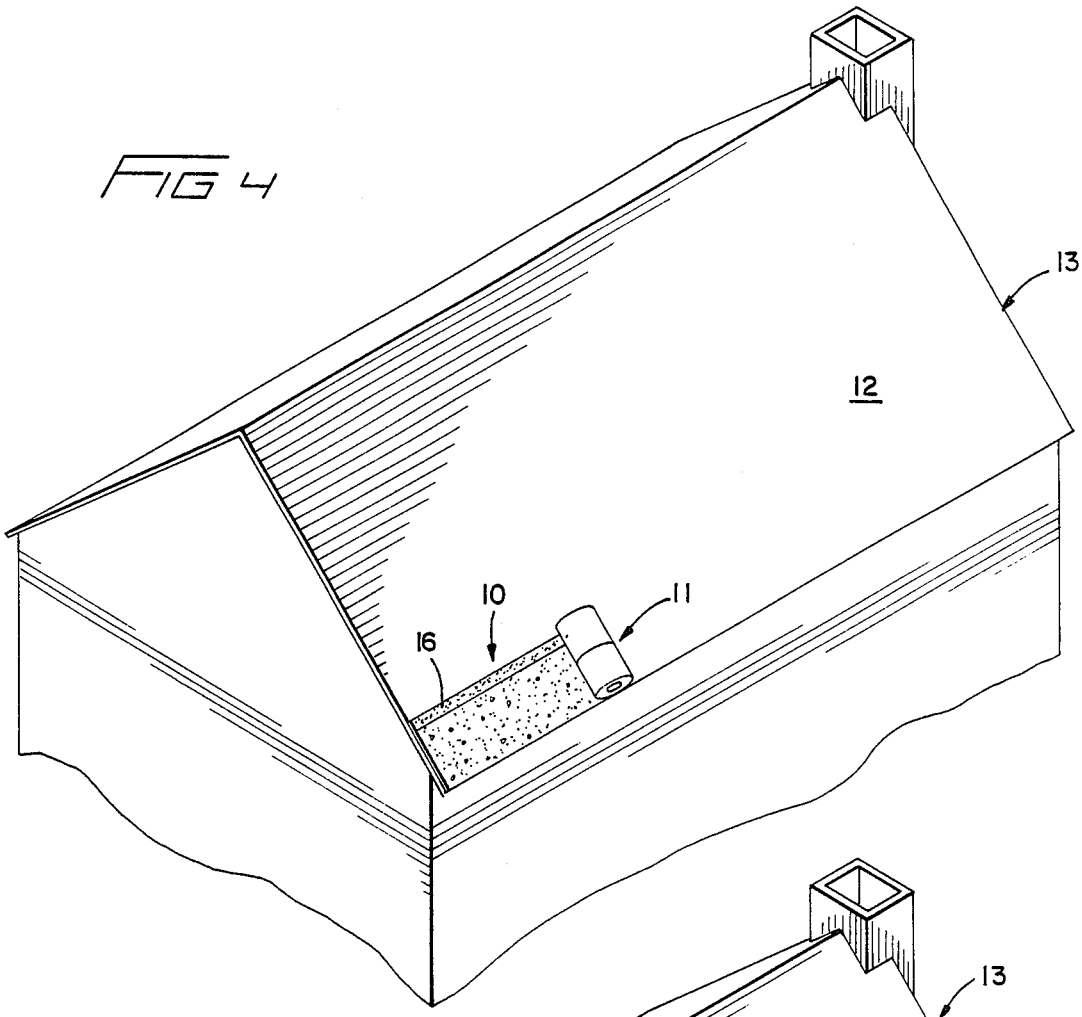
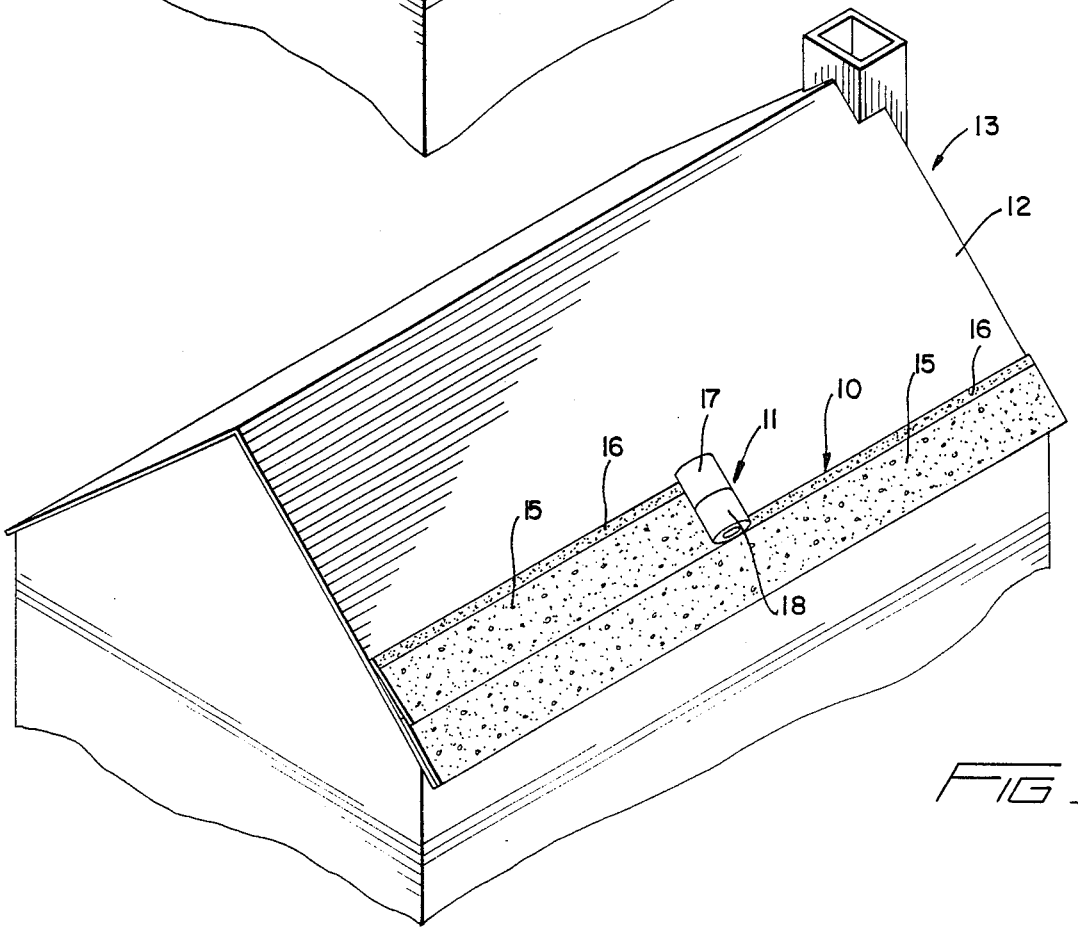
FIG 5

ROOFING PRODUCT

BACKGROUND OF THE INVENTION

The present invention relates to roofing products, and more particularly to roofing products that have a release film on the back thereof and wherein the film is split to allow the material to be flopped back, so that one side can be stuck, and then the other side can be flopped down and stuck.

DESCRIPTION OF THE PRIOR ART

Various types of roofing products or systems are well known, as for example as shown in prior U.S. Pat. Nos. 1,361,517; 2,044,788; 2,847,948; 3,292,334; 3,486,964; 3,741,856; 3,900,102; 4,671,036 and 4,672,790. However, neither these prior patents nor any others known to applicant achieving the results accomplished by the present invention.

OBJECTS AND SUMMARY OF THE PRESENT INVENTION

A primary object of the present invention is to provide a roofing product that has a release film on the back thereof which is split to allow the material to be flopped back, whereby one side is stuck, and then the other side is flopped down and stuck.

Another object of the invention is to provide a roofing product that has roofing granules on the top surface thereof, and wherein there is a selvedge along the length of the product for overlapping several of them on the roof, the back surface having silicone coated two section release film. The composition of the product is made out of polymer-modified bitumen which makes the product self-adhering. A fiberglass reinforcement is arranged inside the product.

Another object of the present invention is to provide a roofing product which is easy to use and which provides waterproof protection for moisture prone areas, the product being self-adhering, easy to apply, and highly effective for the desired purposes.

A still further object of the present invention is to provide a roofing product which will accomplish the desired purposes with maximum efficiency.

These and other objects of the present invention will become apparent with reference to the drawings, the description of the preferred embodiment, and the appended claims.

BRIEF DESCRIPTION OF THE DRAWINGS

FIG. 1 is a top perspective view of the roofing product.

FIG. 2 is a bottom perspective view illustrating the steps of peeling away the film.

FIG. 3 is a sectional view taken on the line 3—3 of FIG. 1.

FIG. 4 is a perspective view illustrating the first step of unrolling the material onto a roof.

FIG. 5 is a view generally similar to FIG. 4 but illustrating the overlapping of the material.

DESCRIPTION OF THE PREFERRED EMBODIMENT

Referring in detail to the drawings, the numeral 10 indicates the roofing product which may be merchandized or sold in roll form, FIGS. 4 and 5, and wherein a roll of the material is indicated by numeral 11. The drawings illustrate the roofing product being used on a roof 12 of a dwelling 13, but it is to be understood that the present invention is not limited to use on any particular area or structure since the same can be used in different areas or for different purposes as desired or required.

The product 10 includes top surface 14 that has roofing granules thereon. As shown in FIG. 1, there is a 3" wide selvedge 16 along the length of the product for overlapping several of them on the roof.

The back surface 21 of the product has silicone coated release film 22 thereon, FIG. 2, and the film 22 includes two sections 17 and 18. When using or applying the product, corner portions 19 of the film sections can be readily manually gripped to peel the film from the back surface 21 of the product. The numeral 24 indicates the overlap for the film sections, FIG. 2.

The composition of the roofing product consists of a body portion 23 that is made out of polymer-modified bitumen which makes the product self-adhering. There is a fiberglass reinforcement 20 inside the product.

The following is given as an example of use of the product for roof installation. The roof product is quick and simple to install and has a split peel-off film for easy application.

The surface preparation is very important as the adhesive will stick to any loose dust rather than to the main surface. The surface therefore must be sound, dry, free from grease or oil and thoroughly cleaned of all dust.

On untreated wood, no further preparation is required but on treated lumber, concrete or metal, use a quick drying asphalt primer. The primer should also be used if installing over shingles or granulated roofing.

Unroll the roofing product along the low edge (eaves) of the roof with the 3" smooth edge towards the top. Align along the roof leaving enough material to fold over the edge.

Tack with a few nails along the smooth edge to hold in place but do not drive the nails all the way in.

Fold back the complete length and peel off half of the backing film, then fold the material back down and press in place.

Remove the nails, fold the remaining material down into place. If required, for additional security or in areas of extreme weather, the material can be renailed every 3 feet in the smooth edge.

Overlap the next piece 3" over the smooth edge and 6" across the end to prevent water seepage.

The roofing product can be shaped easily around corners, chimneys and pipes and can be cut with a regular utility knife.

The product may be sold in lengths of 20 feet, and 3 feet wide and a thickness of approximately 0.110" and a roll of the material may weigh approximately 37 pounds.

As shown in FIG. 1, the top surface 14 has roofing granules 15, and a choice of colors of such granules can be made available. There is a 3" wide selvedge 16 along the length of the product for overlapping several of the products on the roof 12 as for example as shown in FIG. 5.

The back surface 21 has silicone coated 2-section release film 22 which includes the separate sections 17 and 18 which can be readily peeled off by conveniently manually gripping the corner portions 19.

A primary aspect or feature of the present invention is the provision of a roofing product that has the release film on the back thereof, and wherein the film is split to allow the material to be flopped back so that one side can be stuck, and then the other side is flopped down and stuck. The roofing product is adapted to be sold or conveniently merchandised in roll form and wherein the product is quick and simple or easy to install and includes the split peel off film application.

Various options are within the scope of the present invention. For example, the roofing granules can be omitted. The present invention can be used for new construction or reroofing and can be installed on roofs or other surfaces of various formations or shapes. The product does not require any heat or chemical bonding agents and wherein repairs can be made when required.

The bitumen 23 is self-adhering. Durability, ease of installation and flexibility are assured. The product is light in weight and durable and can withstand extreme temperature fluctuations. Also the product is versatile and can be used in various locations such as corners, horizontal surfaces, vertical surfaces and the like. The product is tough and pliable and is supplied in easy-to-apply rolls. In one application the product can be used under shingles, whereas in another application the product can be used instead of shingles.

As previously noted, a primary feature of the present invention is the film that splits in half and wherein the film is of the peel-off type.

Installation is quick and easy and when preparing the surface for the product, it is only necessary to make sure the original surface is clean and dry and that dirt, staples and the like are removed. Installation involves only a few steps.

The product is self-adhering and conveniently packaged. The product is versatile for use with a wide range of commercial and residential applications.

When applying the product, first the membrane is unrolled a few feet along the short edge or valley to obtain the proper alignment. Then the membrane can be rerolled maintaining alignment. Then, the membrane is again unrolled and the release film is removed and the product is placed to the surface. The seams are overlapped, and a small hand roller can be used for applying pressure to the overlap and along the roof edges. The backing includes the siliconized release film. The product is self adhering and can be conveniently packaged.

The bitumen roofing membranes are especially useful for weather proofing and water proofing.

The fiberglass reinforcement 20 gives the products its inner toughness making it highly resistant to tear, water and moisture and contributes to the membrane's long surface life.

The product has an outer coating of fine ground mineral granules for added protection and water proofing and also provides the membrane with exceptional skid resistance.

While the present invention has been described with reference to certain specific embodiments, it will be understood that these embodiments are for illustrative purposes only, and that the true scope of the present invention should be determined only with reference to the following claims.

What is claimed:

1. A roofing product including a roll of material, said roll of material having roofing granules on its top surface thereof, a selvedge arranged along the length of the product for overlapping several of the products on a roof, silicone coated two section release film positioned on the back surface of the product, the release film on the back of the product being split to permit the material to be flopped back, so that one side is stuck and the other side is then dropped down and stuck, the composition of the product consisting of polymer-modified bitumen which makes the product self-adhering, and a fiberglass reinforcement arranged on the inside of the product.

2. The structure as defined in claim 1 wherein the release film consists of two separate strips instead of a single strip or film.

3. A method of quickly and easily installing a roofing product wherein the roofing product has a split peel-off film for easy selective use, comprising the steps of:

first preparing the surface on which the roofing product is to be applied so that the surface is sound, dry, free from grease or oil and wherein all dust is thoroughly cleaned therefrom;

selectively using a quick drying asphalt primer when needed or required;

next unrolling the roofing product along the low edge of a roof of a building and wherein the product has a smooth edge towards the top, and aligning along the roof leaving enough material to fold over the edge;

then tacking with a few nails along the smooth edge to hold the product in place without drividng the nails all the way in;

next folding back the complete length and peeling off half the backing film and then folding the material down and pressing the same in place;

next removing the nails and folding any remaining material down into place, and selectively renailing in the smooth edge; and next overlapping the next piece approximately 3" over the smooth edge and approximately 6" across the end to prevent water seepage, and wherein the product can be shaped easily around corners, chimneys, and pipes and wherein a regular utility knife can be used to cut the product.

4. The method as defined in claim 3 wherein the peel-off film on the back surface of the product consists of two separate strips instead of a single strip or film.

* * * * *